United States Patent [19]

Voss et al.

[11] Patent Number: 4,883,573

[45] Date of Patent: Nov. 28, 1989

[54] REMOVAL OF ACID FROM CATHODIC ELECTROCOATING BATHS BY ELECTRODIALYSIS

[75] Inventors: Hartwig Voss, Frankenthal; Thomas Bruecken, Dortmund, both of Fed. Rep. of Germany

[73] Assignee: BASF Aktiengesellschaft, Ludwigshafen, Fed. Rep. of Germany

[21] Appl. No.: 130,570

[22] Filed: Dec. 9, 1987

[51] Int. Cl.[4] ..... B01D 13/02

[52] U.S. Cl. ..... 204/182.4; 204/301; 204/180.8; 204/299 EC

[58] Field of Search ..... 204/301, 182.4, 182.5, 204/182.3, 149, 151, 152, 300 EC, 299 EC, 180.8

[56] References Cited

U.S. PATENT DOCUMENTS

| | | | |
|---|---|---|---|
| 3,394,068 | 7/1968 | Calmon et al. | 204/182.4 |
| 3,495,465 | 2/1970 | Nordsieck | 74/5 R |
| 3,663,405 | 5/1972 | Christenson et al. | 204/180.8 |
| 3,663,406 | 5/1972 | Bras et al. | 204/180.8 |
| 4,031,050 | 6/1977 | Jerabek | 204/181.7 X |
| 4,057,481 | 11/1977 | Lee et al. | 204/296 |
| 4,105,532 | 8/1978 | Haines et al. | 204/182.4 X |
| 4,140,815 | 2/1979 | Dege et al. | 427/44 |
| 4,190,567 | 2/1980 | Ohmura et al. | 523/414 |
| 4,253,900 | 3/1981 | Dege et al. | 204/182.4 X |
| 4,289,597 | 9/1981 | Grenda | 204/182.4 X |
| 4,355,116 | 10/1982 | Lee et al. | 521/27 |
| 4,552,635 | 11/1985 | Jenczewski et al. | 204/182.4 X |
| 4,581,111 | 4/1986 | Christenson et al. | 204/300 EC X |
| 4,584,246 | 4/1986 | Liu et al. | 428/522 |
| 4,615,780 | 10/1986 | Walker | 204/182.4 X |
| 4,670,125 | 6/1987 | Mueller et al. | 204/296 |
| 4,673,454 | 6/1987 | Liu et al. | 156/281 |

FOREIGN PATENT DOCUMENTS

| | | |
|---|---|---|
| 0012463 | 6/1980 | European Pat. Off. . |
| 0166015 | 1/1986 | European Pat. Off. . |
| 2752555 | 6/1978 | Fed. Rep. of Germany . |
| 3330004 | 2/1985 | Fed. Rep. of Germany . |
| 2111080 | 6/1983 | United Kingdom . |

OTHER PUBLICATIONS

Wilson, J. R. ed. "Demineralization by Electrodialysis", p. 43.

World Surface Coating Abstracts (1978) No. 3929.

*Primary Examiner*—John F. Niebling

*Assistant Examiner*—John S. Starsiak, Jr.

*Attorney, Agent, or Firm*—Keil & Weinkauf

[57] ABSTRACT

Acid is removed from cathodic electrocoating baths by a process in which electroconductive substrates are coated with cationic resins present in the form of aqueous dispersions, at least a portion of the coating bath being subjected to an ultrafiltration where the ultrafiltration membrane retains the cationic resin to form an ultrafiltrate which contains water, solvent, low molecular weight substances and ions and at least a portion of the ultrafiltrate is recycled into the coating bath, and at least a portion of the ultrafiltrate is subjected to a special electrodialysis treatment before being returned into the electrocoating bath.

6 Claims, No Drawings

REMOVAL OF ACID FROM CATHODIC ELECTROCOATING BATHS BY ELECTRODIALYSIS

The present invention relates to a novel process for removing acid from cathodic electrocoating baths where electroconductive substrates are coated with cationic resins present in the form of aqueous dispersions and at least a portion of the coating bath is subjected to an ultrafiltration where the cationic resin is filtered out on the ultrafiltration membrane to leave an ultrafiltrate which contains water, solvent, low molecular weight substances and ions and is at least partly recycled into the coating bath.

Cathodic electrocoating is known and is described for example in great detail in F. Loop, Cathodic electrodeposition for automotive coatings, World Surface Coatings Abstracts (1978), abs. 3929.

In this process, electroconductive substrates are coated with cationic resins present in the form of aqueous dispersions. Cathodically depositable resins customarily contain amino groups. To convert the resins into a stable aqueous dispersion, these groups are protonated with customary acids (also referred to as solubilizing agents in some publications) such as formic acid, acetic acid, lactic acid or phosphoric acid. In an electrocoating process, the protonation is reversed again in the immediate vicinity of the metallic article to be coated, by neutralization with the hydroxyl ions formed by electrolytic water decomposition, so that the binder precipitates (coagulates) on the substrate. The acid is not coprecipitated, so that with time the acid accumulates in the bath. As a result, the pH decreases, which leads to destabilization of the electrocating bath. For this reason, the surplus acid must be neutralized or removed from the bath.

US-A-3,663,405 describes the ultrafiltration of electrocoating compositions. In ultrafiltration, the electrocoating composition is passed under a certain pressure along a membrane which retains the higher molecular weight constituents but lets the low molecular weight constituents such as organic impurities, decomposition products, resin-solubilizing agents (acids) and solvents, pass through. To remove these low molecular weight constituents, a portion of the ultrafiltrate is discarded and thus removed from the system. Another portion of the ultrafiltrate is passed into the rinse deck of the paintline and is used there for rinsing off the dragout still adhering to the coated articles. Ultrafiltrate and rinsed-off dragout are returned into the electrocoating tank for the purposes of recovery. Since the solubilizing agent is used in large amounts, it is not possible to remove it from the bath to a sufficient degree by discarding ultrafiltrate.

US-A-3,663,406 describes the parallel application of ultrafiltration and electrodialysis for working up and controlling the solubilizing agent balance of electrocoating baths. The electrodialysis cell is installed in the electrocoating tank in such a way that the counter-electrode to the coated article is separated from the coating dispersion by an ion exchange membrane and an electrolyte containing the solubilizing agent. By applying an electric field, the ions of opposite charge to the ionic resin groups are made to pass through the ion exchange membrane into the electrolyte and can be bled out from there by way of a separate circulation system. These electrodialysis units installed in the electrocoating tank take up a lot of space and are very expensive to service and repair. The membranes can become blocked with particles from the coating or can be mechanically damaged by the articles to be coated, so that replacement of the membranes becomes necessary. This is time- and labor-consuming and can put the coating process out of operation for a certain period. Ultrafiltration is only required to produce rinse water for the paintline.

For this reason there are processes whereby it is possible to transfer the electrodialysis operation from the electrocoating tank to the periphery of the plant. DE-A-3,243,770 and EP-A-0,156,341 describe processes of this type, where the portion of the ultrafiltrate which is recycled into the rinse zone and then into the electrocoating tank is subjected before entry into the rinse zone to a treatment in the cathode space of an electrolysis cell divided by an anion exchange membrane. In this way the solubilizing agent (acid) accumulated in the ultrafiltrate can be removed from the coating process. The great disadvantage of these electrodialysis processes is that lead from an anticorrosion pigment customarily used in cathodic electrocoating is deposited from the ultrafiltrate at the cathode, as well as other cations. For this reason the cathode was designed to be movable and hence regenerable, which is very expensive.

It is an object of the present invention to remove excess acid from the ultrafiltrate of cathodic electrocoating baths without incurring the disadvantages described above.

We have found that this object is achieved with a process for removing acid from a cathodic electrocoating bath in which an electroconductive substrate is coated with a cationic resin in the form of an aqueous dispersion by separation of the dispersion by ultrafiltration into a resin dispersion and an ultrafiltrate and further treatment of the ultrafiltrate, which comprises (A) passing the ultrafiltrate through the chambers $K_1$ of an electrodialysis cell $Z_A$ comprising the characteristic sequence $$-(K_2-M_1-K_1-M_1)_n-,$$

where $M_1$ is an anion exchanger membrane and n is from 1 to about 500, and passing an aqueous base through the chambers $K_2$, or (B) passing the ultrafiltrate through the chambers $K_1$ of an electrodialysis cell $Z_B$ comprising the characteristic sequence $$-(K_2-M_1-K_1-M_2)_n-,$$

where $M_1$ is an anion exchanger membrane and $M_2$ is a bipolar membrane, and passing water or an electrolyte, preferably the acid to be separated off, a salt of this acid or a mixture thereof, through the chambers $K_2$, or (C) passing the ultrafiltrate through the chambers $K_1$ of an electrodialysis cell $Z_C$ comprising the characteristic sequence $$-(K_3-M_1-K_1-M_1-K_2-M_2)_n-,$$

where $M_1$ is an anion exchanger membrane and $M_2$ is a cation exchanger membrane, and passing an aqueous base through the chambers $K_2$ and water or an electrolyte, preferably the acid to be separated off, a salt of this acid or a mixture thereof, through the chambers $K_3$, and performing the electrodialysis using current densities of up to 100 mA/cm$^2$, the electric field required for this purpose being applied by means of two electrodes at the ends of the electrodialysis cell $Z_A$, $Z_B$ or $Z_C$.

Cathodic electrocoating is feasible with a large number of coatings. Ionic character is conferred upon the coating by cationic resins which customarily contain amino groups which are neutralized with customary acids, for example formic acid, acetic acid, lactic acid or phosphoric acid, to form cationic salt groups. Cationically depositable compositions of this type are described for example in U.S. Pat. No. 4,031,050, U.S. Pat. No. 4,190,567, DE-A-2,752,555 and EP-A-12,463.

These cationic resin dispersions are customarily combined with pigments, soluble dyes, solvents, flow improvers, stabilizers, antifoams, crosslinkers, curing catalysts, salts of lead and other metals, and sundry auxiliary and additive substances as well, to give the electrocoating finishes.

For cathodic electrocoating, the solids content of the electrocoating bath is generally standardized at from 5 to 30, preferably from 10 to 20, % by weight by dilution with deionized water. Deposition generally takes place at from 15° to 40° C. in from 1 to 3 minutes and at pH 5.0–8.5, preferably pH 6.0–7.5, using deposition voltages ranging from 50 to 500 volts. After the film deposited on the electroconductive article has been rinsed off, the said film is cured at from about 140° C. to 200° C. in from 10 to 30 minutes, preferably at from 150° to 180° C. in about 20 minutes.

Electrocoating baths are generally run continuously, ie. the articles to be coated are uninterruptedly introduced into the bath, coated and then removed. This in turn makes it necessary to charge the bath uninterruptedly with coating composition.

It only takes a short time of operation for undesirable impurities and solubilizing agents to accumulate in the bath. Examples of such impurities are oils, phosphates and chromates, which are brought into the bath by the substrates to be coated, carbonates, excess solubilizing agents, solvents and oligomers which accumulate in the bath since they are not codeposited with the resin. Undesirable constituents of this type have an adverse effect on the coating process, so that the chemical and physical properties of the deposited film become unsatisfactory.

To remove these impurities and to keep the composition of the electrocoating bath relatively constant, a portion of the bath is drawn off and subjected to ultrafiltration.

In a cell, the solutions to be ultrafiltered are brought into contact with a filtration membrane arranged on a porous carrier under pressure, for example from a compressed gas or a liquid pump. Any membrane or filter which is chemically compatible with the system and has the desired separating properties can be used. The continuous product is an ultrafiltrate which is collected until the solution retained in the cell has reached the desired concentration or the desired proportion of solvent and of low molecular weight substances dissolved therein has been removed. Suitable ultrafiltration apparatuses are described for example in U.S. Pat. No. 3,495,465.

Although ultrafiltration is useful for removing numerous impurities from the coating bath, it does not provide a satisfactory means of removing solubilizing agents from the bath. One reason why is that in industry the ultrafiltrate is used for washing and rinsing freshly coated articles to remove loosely adhering particles from the coating composition. This wash liquor is recycled into the coating bath. Although a portion of the ultrafiltrate is customarily discarded, this is generally not sufficient to remove the excess of acid. For this reason it is necessary to subject at least a portion of the ultrafiltrate to electrodialysis.

The electrodialysis is carried out using electrodialysis cells $Z_A$, $Z_B$ or $Z_C$, which differ from one another by the characteristic sequences of chambers and membranes described above.

Highly suitable electrodialysis cells comprise for example apparatus equipped with exchange membrane piles and containing up to 800 chambers in a parallel arrangement.

With all three types of electrodialysis cell, the electric field is applied by electrodes at the respective ends of the membrane pile, the electrode rinse being integrated by a separate electrolyte circulation system or in the circulation system of chambers $K_2$ or $K_3$ of electrodialysis cells $Z_A$, $Z_B$ or $Z_C$. While the arrangement of anode and cathode in electrodialysis cell $Z_A$ is freely choosable, the anode in electrodialysis cells $Z_B$ and $Z_C$ is in each case at the left-hand end of the shown characteristic sequence of chambers and membranes, and the cathode in each case at the right-hand end. The bipolar membranes in electrodialysis cell $Z_B$ are arranged with the anion exchanger sides toward the anode and the cation exchanger sides toward the cathode.

Direct current and current densities of 1 up to 100 mA/cm$^2$, preferably from 1 to 30 mA/cm$^2$, are used. The direct voltage required to this end is dependent on the conductivities of solution and membrane and on the membrane spacing.

In electrodialysis cell $Z_A$, the ultrafiltrate is passed through chambers $K_1$ and the aqueous base through chambers $K_2$.

In the electrodialysis cell $Z_B$, the ultrafiltrate is passed through chambers $K_1$ and water or an electrolyte solution, preferably the acid to be separated off, a salt of this acid or a mixture of the two, through chambers $K_2$.

In electrodialysis cell $Z_C$, the ultrafiltrate is passed through chambers $K_1$, the aqueous base through chambers $K_2$ and water or an electrolyte solution, preferably the acid to be separated off, a salt of this acid or a mixture of the two, through chambers $K_3$.

The aqueous base used is an inorganic or organic base. Suitable inorganic bases are hydroxides or carbonates of alkali metals or alkaline earth metals or of ammonium. Preference is given to sodium hydroxide, potassium hydroxide, sodium carbonate, potassium carbonate, calcium hydroxide, barium hydroxide, ammonia or ammonium carbonate. Suitable organic bases are amines such as the trialkylamines, trimethylamine and triethylamine or auxiliary bases such as diazabicyclooctane and dicyclohexylethylamine or polyamines such as polyethyleneimines and polyvinylamines or quaternary ammonium compounds.

The aqueous bases have a pH of up to 14. Preference is given to a pH from 11 to 13, which can be set via the concentration of the base.

The aqueous base or water may also contain one or more salts, preferably comprising a cation of the abovementioned bases and an anion of the abovementioned customary acids, in a concentration of from 0.001 to 10 equivalents per liter, preferably from 0.001 to 1 equivalent per liter. Preference is given to sodium acetate, potassium acetate, sodium lactate and potassium lactate.

The process can be carried out continuously or batchwise. In the continuous process the solution passes once through the electrodialysis cell, while in the batchwise process the solution passes through more than once. Said batch process can be converted into a quasi progressive process by feeding the corresponding solution with fresh ultrafiltrate and fresh base by pH control and at the same time bleeding off deacidified ultrafiltrate and partly neutralized base. In this process, the solutions can pass through the electrodialysis chambers in parallel, cross-flow or countercurrent.

Further electrodialysis cells can be arranged in the form of a multistage cascade, in particular in the case of continuous operation.

Suitable ion exchange membrances are prior art membranes which have for example a thickness of from 0.1 to 1 mm and a pore diameter of from 1 to 30 μm and/or a gel-like structure.

The anion exchange membranes are constructed in accordance with a well-known principle from a matrix polymer which contains chemically bonded cationic groups. In the cation exchanger membranes, the matrix polymer contains anionic groups, and the bipolar membranes have on one side of the surface cationic groups and on the other side of the surface anionic groups.

Examples of matrix polymers are polystyrene which has been crosslinked for example with divinylbenzene or butadiene, high- or low-density polyethylene, polysulfone, aromatic polyether sulfones, aromatic polyether ketones and fluorinated polymers.

The cationic groups are introduced into the matrix polymers by copolymerization, substitution, grafting or condensation. Examples of such monomers are vinylbenzylammonium, vinylpyridinium and vinylimidazolidinium salts. Amines which still have quaternary ammonium groups are introduced into the matrix polymer by way of amide or sulfonamide condensation reactions.

The anionic groups, which in general comprise sulfonate, carboxylate or phosphonate groups, are introduced by copolymerization, condensation, grafting or substitution, for example in the case of sulfonate groups by sulfonation or chlorosulfonation.

Membranes based on polystyrene are commercially available for example under the trade names Selemion ® (from Asahi Glas), Neosepta ® (from Tokoyama Soda), Ionac ® (from Ionac Chemical Company) or Aciplex ® (from Asahi Chem.).

Membranes based on polyethylene grafted with quaternized vinylbenzylamine are obtainable under the trade name Raipore ® R-5035 (from RAI Research Corp.), polyethylene grafted with polytetrafluoroethylene under the trade name Raipore R-1035, polyethylene grafted with styrenesulfonic acid under the trade name R-5010 and polytetrafluoroethylene grafted with styrenesulfonic acid under the trade name R-1010.

EP-A-166,015 describes anion exchange membranes based on polytetrafluoroethylene having a quaternary ammonium group bonded via a sulfonamide group. Cation exchanger membranes on the basis of fluorinated polymers are obtainable for example under the trade name Nafion ® (from DuPont).

The bipolar membranes can be produced by superposing cation and anion exchange membranes, by adhesively bonding cation and anion exchange membranes as described for example in German Laid-Open Application DOS 3,508,206 or U.S. Pat. No. 4,253,900, or as single film membranes. For instance, German Laid-Open Application DOS 3,330,004 describes the production of a bipolar membrane by precipitating an anion exchanger membrane intermediate which is subsequently provided with anionic radicals onto a cation exchanger membrane.

U.S. Pat. Nos. 4,057,481 and 4,335,116 describe processes for producing bipolar membranes where cation exchanger groups are introduced onto one side of a membrane and anion exchanger groups onto the other side. Further patent literture concerned with the production of bipolar membranes includes for example U.S. Pat. No. 4,140,815, EP-A-143,582 and JP Preliminary Published Application 80/99,927.

Although the process is distinguished by high capacities which can be adapted to the requirements via the current, it may happen, depending on the process conditions and the electrocoating bath compositions used, that with time organic material will deposit on the membranes. In these cases the membranes can be subjected to an intermediate rinse with dilute acids.

The solutions passed through the electrodialysis cells have a flow velocity of from 0.001 m/s to 2.0 m/s, preferably from 0.01 to 0.1 m/s.

The electrodialysis is carried out at from 0° to 100° C., preferably from 20° to 50° C., and under from 1 to 10 bar, preferably under atmospheric pressure. The pressure drop across the membranes used is up to 5 bar, in general up to 0.2 bar.

The cathodic electrocoating process is used to coat electroconductive surfaces, for example automotive bodies, metal parts, sheets of brass, copper or aluminum, metallized plastics or materials coated with conductive carbon, and also iron and steel, which may have been chemically pretreated, for example phosphatized.

The process of removing acid from the electrocoating bath by electrodialysis is distinguished by high capacities which can be adapted to the requirements by varying the electric current density. Together with the acid, only insignificant amounts of the other organic and inorganic constituents of the ultrafiltrate are removed.

EXAMPLE 1

Process variant (A) where the electrodialysis cell $Z_A$ has the following structure:

anode—$K_2$—$M_1$—$K_1$—$M_1$—$K_2$—cathode

At 25° C., 150 g of ultrafiltrate having a pH of 5.74 were pumped in a cycle via a stock reservoir vessel through the central chamber ($K_1$) of a round three-chamber electrodialysis cell and 150 g of a sodium hydroxide solution having a pH of 12.2 were pumped in a cycle through the two outer chambers ($K_2$) via a second stock reservoir vessel. The anion exchange membrane used ($M_1$) between the chambers $K_1$ and $K_2$ were of the type Selemion ® DMV (from Asahi Glass). The thickness of the chambers was 1 cm, and the free membrane surface area amounted to 3.14 $cm^2$. During the run, a constant direct current was maintained via two electrodes integrated in the two outer chambers ($K_2$) until the ultrafiltrate had a pH of 6.5. No change in weight of the solutions was detectable at the end of the run. The changes in the composition of the ultrafiltrate and the electric current densities used and the capacities resulting therefrom are listed in Table 1. The electric voltage for maintaining a constant current only varied minimally during any one run. The decrease in the pH of the sodium hydroxide solution was less than 2%.

EXAMPLE 2

Process variant (B) where the electrodialysis cell $Z_B$ has the following structure:

anode—$K_2$—$M_1$—$K_1$—$M_2$—$K_2$—cathode

At 25° C., 150 g of ultrafiltrate having a pH of 5.74 were pumped in a cycle through the central chamber ($K_1$) of a round three-chamber electrodialysis cell via a stock reservoir vessel and 150 g of a sodium acetate/acetic acid solution (composition: 0.067 mol of sodium acetate/kg, acidified with acetic acid to pH 6.5) through the two outer chambers ($K_2$) via a second stock reservoir vessel. The anion membrane used ($M_1$) between the chamber $K_1$ and the anode-side chamber $K_2$ were of the type Selemion ® DMV and the bipolar membrane ($M_2$) between the chamber $K_1$ and the cathode-side chamber $K_2$ comprised two superposed membranes of the type Selemion ® CMV (cation exchanger membrane) and AMV (anion exchanger membrane; all membranes from Asahi Glass). The bipolar membrane was disposed with its anion exchange side toward the anode and its cation exchanger side toward the cathode. The thickness of the chambers was 1 cm, and the free membrane surface area amounted to 3.14 $cm^2$. During the run a constant direct current was maintained via two electrodes integrated in the two outer chambers ($K_2$) until the ultrafiltrate had a pH of 6.5. No change in weight of the solutions was detectable at the end of the run. The changes in the composition of the ultrafiltrate and the electric current densities used and the capacities resulting therefrom are listed in Table 1. The electric voltage for maintaining a constant current only varied minimally during any one run.

EXAMPLE 3

Process variant (A) where the electrodialysis cell $Z_A$ has the following structure:

anode—$K_2$—$M_1$—$K_1$—$M_1$—$K_2$—cathode

At 25° C., 150 g of ultrafiltrate having a pH of 5.73 were pumped in a cycle through the central chamber ($K_1$) of a round three-chamber electrodialysis cell via a stock reservoir vessel and 150 g of a sodium hydroxide solution having a pH of 12.0 through the two outer chambers ($K_2$) via a second stock reservoir vessel. The anion exchange membranes used ($M_1$) between the chanmbers $K_1$ and $K_2$ were of the type Ionac ® MA-3475 (from Ionac Chemical Company). The thickness of the chambers was 1 cm, and the free membrane surface area amounted to 3.14 $cm^2$. During the run, a constant direct current was maintained via two electrodes integrated in the two outer chambers ($K_2$) until the ultrafiltrate had a pH of 6.5. No change in weight of the solutions was detectable at the end of the run. The changes in the composition of the ultrafiltrate and the electric current densities used and the capacities resulting therefrom are listed in Table 2. The electric voltage for maintaining a constant current only varied minimally during any one run. The decrease in the pH of the sodium hydroxide solution was less than 2%.

EXAMPLE 4

Process variant (A) where the electrodialysis cell $Z_A$ has the following structure:

anode—$K_2$—$M_1$—$K_1$—$M_1$—$K_2$—cathode

At 25° C., 150 g of ultrafiltrate having a pH of 5.73 were pumped in a cycle through the central chamber ($K_1$) of a round three-chamber electrodialysis cell via a stock reservoir vessel and 150 g of a sodium hydroxide solution having a pH of 12.0 through the two outer chambers ($K_2$) via a second stock reservoir vessel. The anion exchange membranes used ($M_1$) between the chambers $K_1$ and $K_2$ were of the type Aciplex ® A-201 (from Asahi Chemical). The thickness of the chambers was 1 cm, and the free membrane surface area amounted to 3.14 $cm^2$. During the run, a constant direct current was maintained via two electrodes integrated in the two outer chambers ($K_2$) until the ultrafiltrate had a pH of 6.5. No change in weight of the solutions was detectable at the end of the run. The changes in the composition of the ultrafiltrate and the electric current densities used and the capacities resulting therefrom are listed in Table 2. The electric voltage for maintaining a constant current only varied minimally during any one run. The decrease in the pH of the sodium hydroxide solution was less than 2%.

EXAMPLE 5

Process variant (C) where the electrodialysis cell $Z_C$ has the following structure:

anode—$K_2$—$M_2$—$K_3$—$M_1$—$K_1$—$M_1$—$K_2$—cathode

At 25° C., 150 g of ultrafiltrate having a pH of 5.73 were pumped in a cycle through the chamber ($K_1$) of a round four-chamber electrodialysis cell via a stock reservoir vessel, 150 g of 0.14% strength by weight sodium acetate solution through chamber $K_3$ via a second stock reservoir vessel, and 150 g of a sodium hydroxide solution having a pH of 12.0 through the two outer chambers $K_2$ via a third stock reservoir vessel. The anion exchanger membranes used ($M_1$) between the chambers $K_1$ and $K_2$ on the one hand and $K_1$ and $K_3$ on the other were of the type Aciplex ® A-201 (from Asahi Chemical), and the cation exchange membrane ($M_2$) between chambers $K_2$ and $K_3$ was of the type Selemion ® CMV (from Asahi Glass). The thickness of the chambers was 1 cm, and the free membrane surface area amounted to 3.14 $cm^2$. During the run, a constant direct current was maintained via two electrodes integrated in the two outer chambers ($K_2$) until the ultrafiltrate had a pH of 6.5. No change in weight of the solutions was detectable at the end of the run. The changes in the composition of the ultrafiltrate and the electric current densities used and the capacities resulting therefrom are listed in Table 2. The electric voltage for maintaining a constant current only varied minimally during any one run. The decrease in the pH of the sodium hydroxide solution was less than 2%.

EXAMPLE 6

Process variant (A) where the electrodialysis cell $Z_A$ has the following structure:

anode—$K_2$—$M_1$—$K_1$—$M_1$—$K_2$—cathode

At 25° C., 150 g of ultrafiltrate having a pH of 5.73 were pumped in a cycle through the central chamber ($K_1$) of a round three-chamber electrodialysis cell via a stock reservoir vessel and 150 g of sodium hydroxide solution having a pH of 12.0 through the two outer chambers ($K_2$) via a second stock reservoir vessel. The anion exchange membranes used ($M_1$) between the chambers $K_1$ and $K_2$ were of the type Ionac ® MA-3475 (from Ionac Chemical Company). The thickness of the chambers was 1 cm, and the free mem-brane surface area amounted to 3.14 $cm^2$. During the run, a constant direct durrent was maintained via two electrodes integrated in the two outer chambers ($K_2$) until the ultrafiltrate had a pH of 6.5. The pH of the sodium hydroxide solution was then 11.8.

At the end of the run, the solutions were discharged and replaced by fresh ones without an intermediate rinse, and the run was repeated under identical conditions. Table 3 shows for 11 such runs in succession the time required, the change in ultrafltrate pH, the electric current density at the start and the end of the run and the resulting capacity.

No decrease in capacity was detectable.

TABLE 1

| | Ultrafiltrate composition before and after electrodialysis; electric current densities and capacities for Examples 1 and 2 | | | | | | | | | |
|---|---|---|---|---|---|---|---|---|---|---|
| | pH | FK [%] | $Pb^{++}$ [ppm] | $Na^{+}$ [ppm] | $Cl^{-}$ [ppm] | Ac [%] | PM [%] | BG [%] | j [mA/cm²] | Capacity [kg UF/m² · h] |
| Ultrafiltrate feed for Examples 1 and 2 | 5.74 | 0.51 | 685 | 10 | | 0.1 | 0.09 | 0.61 | — | |
| Dragout Example 1 | 6.5 | 0.39 | 675 | 9.5 | | 0.1 | 0.11 | 0.55 | 2.0 | 274 |
| | 6.5 | | | | | | | | 4.0 | 474 |
| Dragout Example 2 | 6.5 | 0.38 | 671 | 13 | | 0.1 | 0.12 | 0.59 | 2.0 | 144 |
| | 6.5 | | | | | | | | 4.0 | 246 |
| | 6.5 | | | | | | | | 10.0 | 757 |
| | 6.5 | | | | | | | | 22.6 | 1462 |

FK = solids
$Ac^{-}$ = acetate
PM = methoxypropanol
BG = butylglycol
Capacity = amount of ultrafiltrate brought to pH 6.5 per hour per m² of total membrane surface area

TABLE 2

| | Ultrafiltrate composition before and after electrodialysis; electric current densities and capacities for Examples 3, 4 and 5 | | | | | | | | | |
|---|---|---|---|---|---|---|---|---|---|---|
| | pH | FK [%] | $Pb^{++}$ [ppm] | $Na^{+}$ [ppm] | $Cl^{-}$ [ppm] | $Ac^{-}$ [%] | PP [%] | BG [%] | j [mA/cm²] | Capacity [kg UF/m² · h] |
| Ultrafiltrate feed for Examples 3, 4 and 5 | 5.73 | 0.30 | 556 | 17 | 14 | 0.1 | 0.23 | 0.50 | — | — |
| Dragout Example 3 | 6.5 | 0.29 | 541 | 12 | 12 | <0.1 | 0.20 | 0.49 | 11.3 | 1031 |
| | 6.5 | 0.30 | 522 | 11 | 14 | <0.1 | 0.25 | 0.51 | 11.8 | 916 |
| | 6.5 | 0.30 | 546 | 13 | 13 | <0.1 | 0.23 | 0.49 | 12.4 | 1077 |
| Dragout Example 4 | 6.5 | 0.29 | 539 | 12 | 15 | <0.1 | 0.21 | 0.45 | 11.6 | 1124 |
| Dragout Example 5 | 6.5 | 0.28 | 541 | 24 | 21 | <0.1 | 0.20 | 0.48 | 7.0 | 427 |
| | 6.5 | 0.28 | 535 | 21 | 18 | <0.1 | 0.21 | 0.47 | 14.0 | 808 |

FK = solids
$Ac^{-}$ = acetate
PP = phenoxypropanol
BG = butylglycol
Capacity = amount of ultrafiltrate brought to pH 6.5 per hour per m² of total membrane surface area

TABLE 3

| | Measurements pertaining to Example 6 | | | |
|---|---|---|---|---|
| Run No. | Time [min] | pH UF | j [mA/cm²] | Capacity [kg UF/m² · h] |
| 1 | 0 | 5.73 | 12.2 | |
| | 16.0 | 6.50 | 11.3 | 895 |
| 2 | 0 | 5.73 | 11.1 | |
| | 16.6 | 6.50 | 9.0 | 863 |
| 3 | 0 | 5.73 | 11.5 | |
| | 15.5 | 6.50 | 10.2 | 924 |
| 4 | 0 | 5.73 | 11.6 | |
| | 14.2 | 6.50 | 10.3 | 1009 |
| 5 | 0 | 5.73 | 11.4 | |
| | 15.9 | 6.50 | 10.1 | 901 |
| 6 | 0 | 5.73 | 11.5 | |
| | 15.3 | 6.50 | 10.2 | 936 |
| 7 | 0 | 5.73 | 11.5 | |
| | 14.3 | 6.50 | 10.2 | 1002 |
| 8 | 0 | 5.73 | 11.5 | |
| | 15.0 | 6.50 | 10.2 | 955 |
| 9 | 0 | 5.73 | 12.3 | |
| | 12.8 | 6.50 | 11.0 | 1119 |
| 10 | 0 | 5.73 | 12.1 | |
| | 13.3 | 6.50 | 10.8 | 1077 |
| 11 | 0 | 5.73 | 11.9 | |
| | 14.3 | 6.50 | 10.7 | 1002 |

We claim:

1. A process for removing acid from a cathodic electrocoating bath in which an electroconductive substrate is coated with a cationic resin present in the form of an aqueous dispersion, by separation of the dispersion by ultrafiltration into a resin dispersion and an ultrafiltrate and further treatment of the ultrafiltrate comprising the steps of passing the ultrafiltrate through the chambers $K_1$ of an electrodialysis cell $Z_C$ comprising the characteristic sequence $$-(K_3-M_1-K_1-M_1-K_2-M_2)_n-,$$

where $M_1$ is an anion exchange membrane and $M_2$ is a cation exchange membrane, and passing an aqueous base through the chambers $K_2$ and water or an electrolyte, preferably the acid to be separated off, a salt of this acid or a mixture thereof, through the chambers $K_3$, and performing the electrodialysis using current densities of up to 100 mA/cm², the electric field required for this purpose being applied by means of two electrodes at the ends of the electrodialysis cell $Z_C$.

2. The process of claim 1, wherein the aqueous base used additionally contains a salt.

3. The process of claim 1, wherein the flow velocity of the liquids in the electrodialysis cells ranges from 0.001 to 2 m/s.

4. The process of claim 1, wherein the electrodialysis is carried out at from 0° to 100° C.

5. The process of claim 1, wherein an aqueous base having a pH of up to 14 is used.

6. The process of claim 5, wherein the base used is sodium hydroxide, potassium hydroxide, sodium carbonate potassium carbonate, calcium hydroxide, barium hydroxide, ammonia, ammonium carbonate, an amine or a quaternary ammonium hydroxide.

* * * * *

UNITED STATES PATENT AND TRADEMARK OFFICE

CERTIFICATE OF CORRECTION

PATENT NO. : 4,883,573

DATED : November 28, 1989

INVENTOR(S) : Hartwig VOSS et al.

It is certified that error appears in the above-identified patent and that said Letters Patent is hereby corrected as shown below:

ON THE COVER PAGE insert --Foreign Application Priority Data

December 10, 1986 Federal Republic of Germany ... 3642164--

Signed and Sealed this

Twenty-second Day of October, 1991

*Attest:*

HARRY F. MANBECK, JR.

*Attesting Officer*

*Commissioner of Patents and Trademarks*